US009294848B2

(12) United States Patent
Barthel et al.

(10) Patent No.: US 9,294,848 B2
(45) Date of Patent: Mar. 22, 2016

(54) ADAPTATION OF A CLASSIFICATION OF AN AUDIO SIGNAL IN A HEARING AID

(75) Inventors: Roland Barthel, Forchheim (DE); Marko Lugger, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 49 days.

(21) Appl. No.: 14/374,956

(22) PCT Filed: Jan. 27, 2012

(86) PCT No.: PCT/EP2012/051371

§ 371 (c)(1),
(2), (4) Date: Jul. 28, 2014

(87) PCT Pub. No.: WO2013/110348

PCT Pub. Date: Aug. 1, 2013

(65) Prior Publication Data

US 2014/0369510 A1 Dec. 18, 2014

(51) Int. Cl.
*H04R 29/00* (2006.01)
*H04R 25/00* (2006.01)

(52) U.S. Cl.
CPC ..... *H04R 25/43* (2013.01); *H04R 25/50* (2013.01); *H04R 25/505* (2013.01); *H04R 2225/41* (2013.01)

(58) Field of Classification Search
CPC ..... H04N 11/00; G01H 3/14
USPC ..... 381/56
See application file for complete search history.

(56) References Cited

U.S. PATENT DOCUMENTS 7,995,781 B2 8/2011 Allegro Baumann et al.
2002/0191799 A1* 12/2002 Nordqvist ..... H04R 25/505 381/60
2007/0250461 A1* 10/2007 Sabe ..... G06F 15/18 706/12
2007/0269053 A1* 11/2007 Meier ..... H04R 25/70 381/74

FOREIGN PATENT DOCUMENTS

EP 1513371 A2 3/2005

OTHER PUBLICATIONS

Büchler, Michael Christoph: "Algorithms for Sound Classification in Hearing Instruments"—A dissertation submitted to the Swiss Federal Institute of Technology Zurich, 2002. Diss.ETH No. 14498.

* cited by examiner

*Primary Examiner* — Simon King
(74) *Attorney, Agent, or Firm* — Laurence A. Greenberg; Werner H. Stemer; Ralph E. Locher

(57) ABSTRACT

A method determines the classification of an audio signal in dependence on a comparison of two difference sums of audio features over time periods of different length. Thus, an adequately exact yet quickly reacting adaptation of the classification in changing hearing situations is ensured. The method is advantageously used in a hearing aid. The audio signal is processed in different ways on the basis of the classification.

12 Claims, 5 Drawing Sheets

ADAPTATION OF A CLASSIFICATION OF AN AUDIO SIGNAL IN A HEARING AID

BACKGROUND OF THE INVENTION

Field of the Invention

The present invention relates to a method for adapting a classification of audio signals. The present invention further relates to a corresponding signal processor and a hearing aid.

Hearing devices are primarily used to improve the clarity of audio signals from sound waves for a desired purpose in each case. One field of use for hearing devices as a hearing aid is the care of those with a hearing impairment. The amplification function of a hearing device is achieved by means of the integrated electronics. One or more microphones in the hearing device receive an audio signal, which is processed by means of an audio processor and output again from an earphone.

Different hearing situations are produced depending on the location of the hearing device user. Desirable and undesirable sounds occur in many hearing situations, e.g. a car journey. In the example of the car journey, the voice of a fellow passenger is desirable while the noise of the vehicle is undesirable. A hearing device should preferably filter out and then process desirable sounds only. Hearing situations which occur frequently can be classified. This classification is performed by a signal processor, which uses an algorithm to assign a specific classification to an audio signal on the basis of one or more possible audio features of said audio signal. An audio feature may be a level or amplitude of an audio signal, for example. An audio processor can then process the audio signal further using the relevant classification information accordingly. An audio processor has various processing programs, which are selected as a function of the classification.

The process of setting a classification is essentially influenced by two requirements, the first being to set a classification which most closely matches the current hearing situation and the second being to effect this setting quickly. However, accuracy and rapid change of classification represent conflicting requirements.

BRIEF SUMMARY OF THE INVENTION

The object of the present invention is to allow a rapid change of classification in response to a changed hearing situation, while ensuring a reliably stable classification.

This object is achieved by a method for adapting a classification of an audio signal, a method for classifying an audio signal, and a hearing aid.

By comparing difference sums of audio features, which are summed over time periods of different length, brief changes in the received audio signal can be identified reliably with reference to a longer monitoring period, thereby forming a reliable basis for performing a change of classification. The change of classification is based on the temporal sequence of differences of consecutive values of an audio feature of the audio signal, and therefore the change is considered in the form of a multiplicity of intermediate values over a specific duration, whereby a change of the hearing situation is reliably reflected in the differences of the feature values. A change in the audio signal is identified quickly by examining a first time period of shorter duration, while adequate stability of the classification is ensured by virtue of the reference to a second time period of longer duration.

An audio feature is a variable derived from an audio signal. The audio feature typically relates to a temporal aspect, i.e. phase or frequency, or to the amplitude of an audio signal. The audio feature therefore changes over time according to the audio signal. In the following, the audio feature can also be a mean value, a standard deviation, a modulation or a variance of a level of the audio signal.

According to a development, the comparison is effected by means of a quotient from the first sum and the second sum. A quotient can easily be determined by means of a simple mathematical operation and represents a meaningful measure of the relationship between the first sum and the second sum.

According to a development, a temporal sequence of values of various types of audio features is generated and the difference is formed from individual differences of the consecutive values of audio features of the same type. The audio features may be mean values, standard deviations, modulations or variances of a level of an audio signal. Using various types of audio features instead of being limited to a specific audio feature improves the accuracy of the classification. When forming the difference, the individual differences are weighted according to the type of the respective audio feature, thereby providing increased flexibility when specifying a change of classification in the method according to the invention.

According to a development, the values of the various types of audio features are combined to produce a feature vector and the difference is obtained in the form of a distance between consecutive feature vectors. By virtue of said combination into a vector, the audio features can be processed more easily.

According to a development, the change of classification is performed as a function of a currently selected classification. By virtue of the change of classification also depending on a currently selected classification, the stability and/or the response speed for a change of classification can by controlled as a function of the classification. For example, the change of classification from a hearing situation for speech can only take place if the comparison of the sum difference of the sequence of audio features indicates particularly clearly that the hearing situation has changed, in order thereby to achieve greater stability for the class for speech.

The first time period advantageously has a duration of 2 to 6 seconds and the second time period a duration of 10 to 20 seconds.

Also provided is a method for classifying an audio signal, wherein said method comprises the steps of the method cited in the introduction and, in addition, steps for preparing a change of classification by selecting a proposal for an adapted classification as a function of a value of the audio feature, and performing the change of classification in accordance with the proposal for an adapted classification as a function of the comparison.

A specific proposal is made for a change of classification. The additional presence of such a proposal reduces the time required to change to a classification, since the proposal can be used as a basis for changing to a classification without having to perform the entire calculation for the classification change.

The present invention is now explained with reference to exemplary embodiments in the appended drawings, in which:

DESCRIPTION OF THE INVENTION

Figure 1:
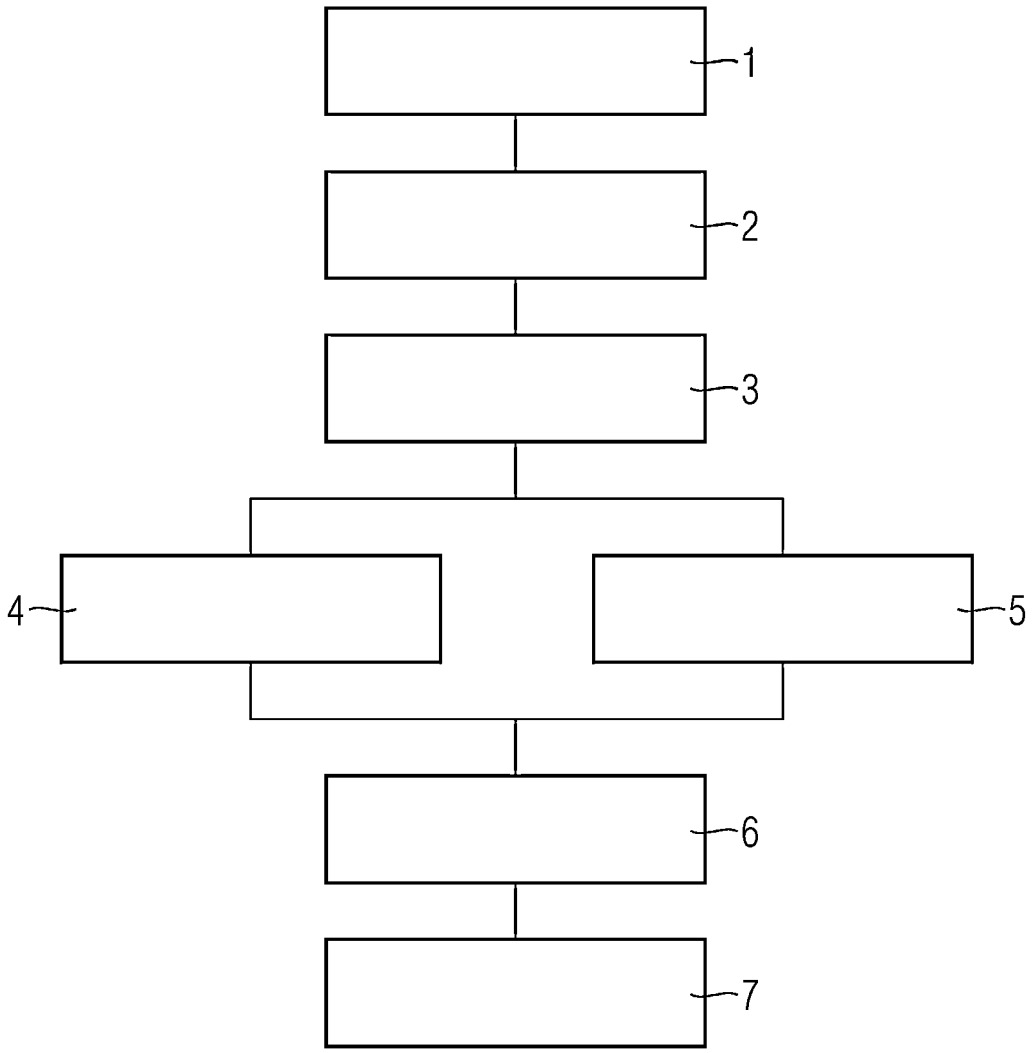
FIG. 1 shows the operation of a method for adapting the classification of an audio signal according to an embodiment of the invention.

FIG. 1 schematically shows the operation of a method according to an embodiment of the present invention. This method can be executed in a signal processor of a hearing aid, for example.

In a first step 1, an audio signal is provided. This audio signal is typically a microphone signal of the hearing aid. The microphone signal can be supplied by one or more microphones of the hearing aid. Further signal preparation means may also be connected between the microphone or microphones and the signal processor, e.g. for the purpose of smoothing the microphone signal.

In a second step 2, a temporal sequence of values $u_k$ of an audio feature is generated. The values of the sequence are numbered in chronological order by an index k in this case. Provision is advantageously made for considering not just a single audio feature, but a plurality of audio features of various types. In this case, $u_k$ represents a feature vector which combines the values of this audio feature at the time point $t_k$ corresponding to the index k. The temporal separation between two consecutive time points $t_{k-1}$ and $t_k$ may be 10 ms to 200 ms, for example. The audio feature represents characteristic properties of the audio signal at a specific time point. The audio feature is typically determined from the temporal course of the audio signal in a temporal vicinity of the respective time point. A person skilled in the art will be familiar with various audio features per se, e.g. a mean value, a standard deviation, a modulation or a variance of a level of the audio signal.

In a third step 3, a difference $u_k-u_{k-1}$ is formed in each case from consecutive values $u_{k-1}$ and $u_k$ of the audio features. In this way, a sequence of differences is therefore obtained for the various values k=1, 2, 3, etc. of the index. Of primary importance for the subsequent method steps is the absolute amount of this difference, i.e. $d_k=|u_k-u_{k-1}|$. In the case of a feature vector for a multiplicity of audio features, $d_k$ represents the distance of the consecutive vectors $u_{k-1}$ and $u_k$. The distance can be variously selected, e.g. as a Euclidean distance or a Mahalanobis distance. The audio features can also be variously weighted in this distance, e.g. by means of multiplying the feature values by various scalar coefficients before the distance is determined. In the following, $d_k$ is only defined as a difference, though it can also represent the absolute amount of the difference or the distance depending on the embodiment.

In the next steps 4 and 5, the sequence of differences $d_k$ is processed in different ways, in that they are summed over time periods of different length. In step 4, the differences are summed over a first time period $T_1$ to give a first sum $\Sigma_1$. In step 5, however, the differences are summed over a longer time period $T_2$ to give a second sum $\Sigma_2$. The shorter time period $T_1$ may be 2 to 5 seconds and the longer time period $T_2$ may be 10 to 20 seconds, for example. In this exemplary embodiment, the longer time period $T_2$ is two to ten times longer than the shorter time period $T_1$. For a shorter time period $T_1$ of e.g. 2 seconds and a temporal separation of the consecutive values of the audio signals of e.g. 10 ms, 200 individual values of differences of the values $u_k$ are therefore summed for the time period $T_1$, said individual values corresponding to the time points $T_k$ which lie in the time period $T_1$. The sum of the differences therefore describes the totality of all individual changes of the audio features over the respective time period of the sum.

In a sixth step 6, the two sums $\Sigma_1$ and $\Sigma_2$ over the elapsed respective time periods $T_1$ and $T_2$ are compared with each other. On the basis of this comparison of the totality of the individual changes over two time periods of different length, it is possible to identify any short-term changes in relation to a longer-term trend. The comparison is made in a simple manner by generating a quotient from $\Sigma_1$ and $\Sigma_2$, wherein the relative length of the two time periods must be taken into consideration when evaluating the quotient. For example, the value of the quotient $$Q = \frac{\sum_1 \cdot T_2}{\Sigma_2 \cdot T_1}$$

where $T_2 > T_1$ can be used for the comparison. This effectively means that the average rate of change $\Sigma_1/T_1$ in the shorter time period $T_1$ is compared with the average rate of change $\Sigma_2/T_2$ in the longer time period $T_2$. If the value of Q is significantly greater than 1, this indicates a noticeable increase in the rate of change in the time period $T_1$.

In a seventh step 7, a change of classification is performed as a function of the comparison in the preceding step 6. In this case, provision is not made for selecting the classification itself, but merely for implementing a classification which has been proposed by other means. The classification proposal per se can be determined in a conventional manner as a function of the hearing situation. By virtue of the present method, a change of classification is therefore inhibited if the above described comparison indicates that the hearing situation has not changed appreciably in the preceding time period $T_1$. However, since a relatively short time period $T_1$ is selected, this method allows a change of classification to be determined quickly yet reliably.

The method can be fine-tuned by taking various audio features into consideration and optionally also applying a weighting to these various audio features. The selection and weighting can be improved by a series of tests in various changing hearing situations, for example, in order to allow accurate detection of a change in the hearing situation.

The change of classification can also be performed according to the currently selected hearing situation. For example, it is desirable for e.g. the hearing situation "speech in quiet" to be particularly resistant to an incorrect change of classification, while other classifications such as "car", "music", "quiet" or "interference noise" may be changed more readily. This change can also depend on a proposed new classification, such that e.g. a change to the hearing situation "speech in quiet" can take place particularly quickly. The current and/or proposed classification can also take into consideration the weighting of the audio features in the determination of the distances. For further improvement, the summing time periods $T_1$ and $T_2$ can also depend on the current and/or proposed classification.

The hearing situation "speech in quiet" occurs when a person is speaking in otherwise quiet surroundings. In addition to this, other classifications are known in respect of the hearing situations for a car ("car"), music ("music"), quiet surroundings ("quiet"), interference noise ("interference noise") and many other situations. The classification of the hearing situation is likewise performed by the hearing aid on the basis of the audio signal, wherein the above cited audio features can also be taken into consideration. Depending on the respective hearing situation, a suitable hearing program for the hearing situation is specified for processing the audio signal. The audio signal which is processed by the respective hearing program is reproduced in amplified form for the hearing aid wearer. The hearing program specifies e.g. different types of frequency filters, the amplification level, which is possibly also frequency-dependent, and the directivity of the microphones.

Figure 2:
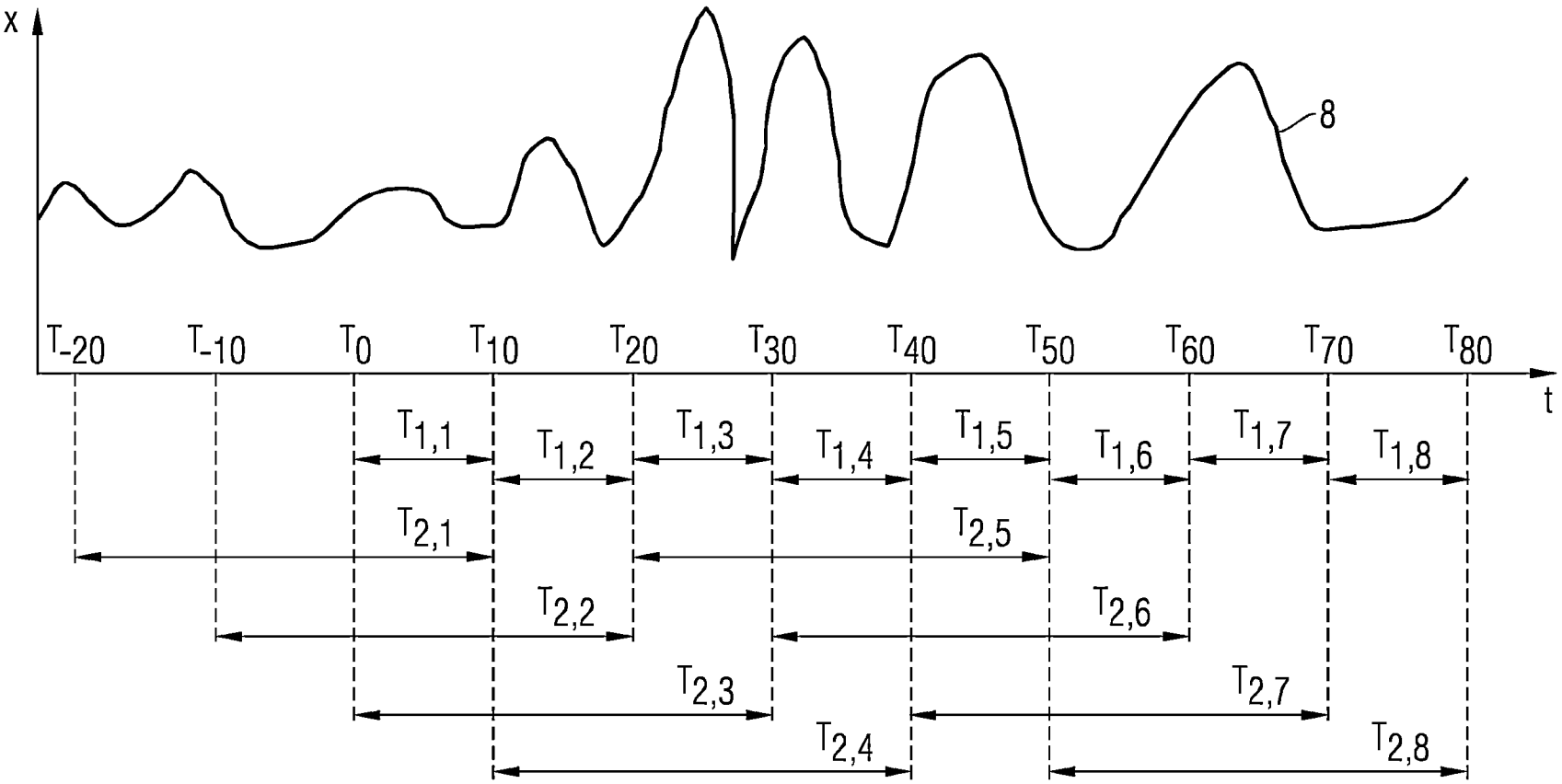
FIG. 2 shows the temporal course of an audio signal and in relation thereto the associated time periods that are relevant for the method according to FIG. 1.

FIG. 2 schematically shows the temporal course of an audio signal 8 and the relationship of the individual time periods $T_{1,i}$ and $T_{2,i}$ over which the sequence of differences of the values of the audio features are summed. A time period for k=−20 to k=+80 is shown. Every tenth time point $t_k$ is specified on the horizontal time axis by way of example. The vertical axis specifies the respective amplitude of the audio signal 8.

A sequence of short time periods $T_{1,i}$ and a further sequence of longer time periods $T_{2,i}$ are indicated below the time axis. The short time periods $T_{1,i}$ have ten individual intervals between the time points $t_k$ in each case. The associated sums $\Sigma_{1,i}$ therefore comprise the differences of ten consecutive value pairs $u_{k-1}$ and $u_k$. The longer time periods $T_{2,i}$ are three times as long as the short time periods $T_{1,i}$ in each case. The associated sums $\Sigma_{2,i}$ therefore comprise the differences of thirty consecutive value pairs $u_{k-1}$ and $u_k$.

The numbering of the index is selected such that the intervals $T_{1,i}$ and $T_{2,i}$ for the same index i end at the same time point $t_k$ with k=10·i. The time period $T_{1,i}$ always lies within the time period $T_{2,i}$ in this case, both ending at the same time point. Alternatively, $T_{1,i}$ can also link directly to the time period $T_{2,i}$. In any case, $T_{1,i}$ and $T_{2,i}$ should be closely related.

With each increment of the index i, the time intervals $T_{1,i}$ and $T_{2,i}$ are shifted by the same amount, such that the relationship between these intervals is maintained. In this case, the time intervals $T_{1,i}$ are shifted by the same duration as the time periods $T_{1,i}$, such that the time periods follow each other without interruption relative to time. Alternatively, the shift may also be longer or shorter than the time intervals $T_{1,i}$.

In the present case, the sums $\Sigma_{1,i}$ and $\Sigma_{2,i}$ can be represented in the form of equations as follows:

$$\sum\nolimits_{1,i} = \sum_{k=10\cdot i-9}^{10\cdot i} |u_k - u_{k-1}|$$

$$\sum\nolimits_{2,i} = \sum_{k=10\cdot i-29}^{10\cdot i} |u_k - u_{k-1}|$$

These sums can in turn be used to form the following quotients $Q_i$, on the basis of which the change of classification is performed:

$$Q_i = \frac{\sum_{1,i} \cdot T_{2,i}}{\sum_{2,i} \cdot T_{1,i}}$$

As described above, $u_k$ can be an individual numerical value for a feature or a vector comprising a multiplicity of individual values for various audio features. In the case of an individual numerical value, $|u_k|$ represents the absolute value. In the case of a vector, $u_k$ is specified in the form of an ordered set of numerical values $(u_k)_n$, where n is the index by means of which the individual numerical values are differentiated. Various norms can be selected according to the field of use. One possible norm is the Euclidean norm, which is defined as follows:

$$|u_k| = \sqrt{\sum_n (u_k)_n^2}$$

The sum is produced over all of the vector entries. Alternatively, $|u_k - u_{k-1}|$ can be defined as a Mahalanobis distance.

Figure 3:
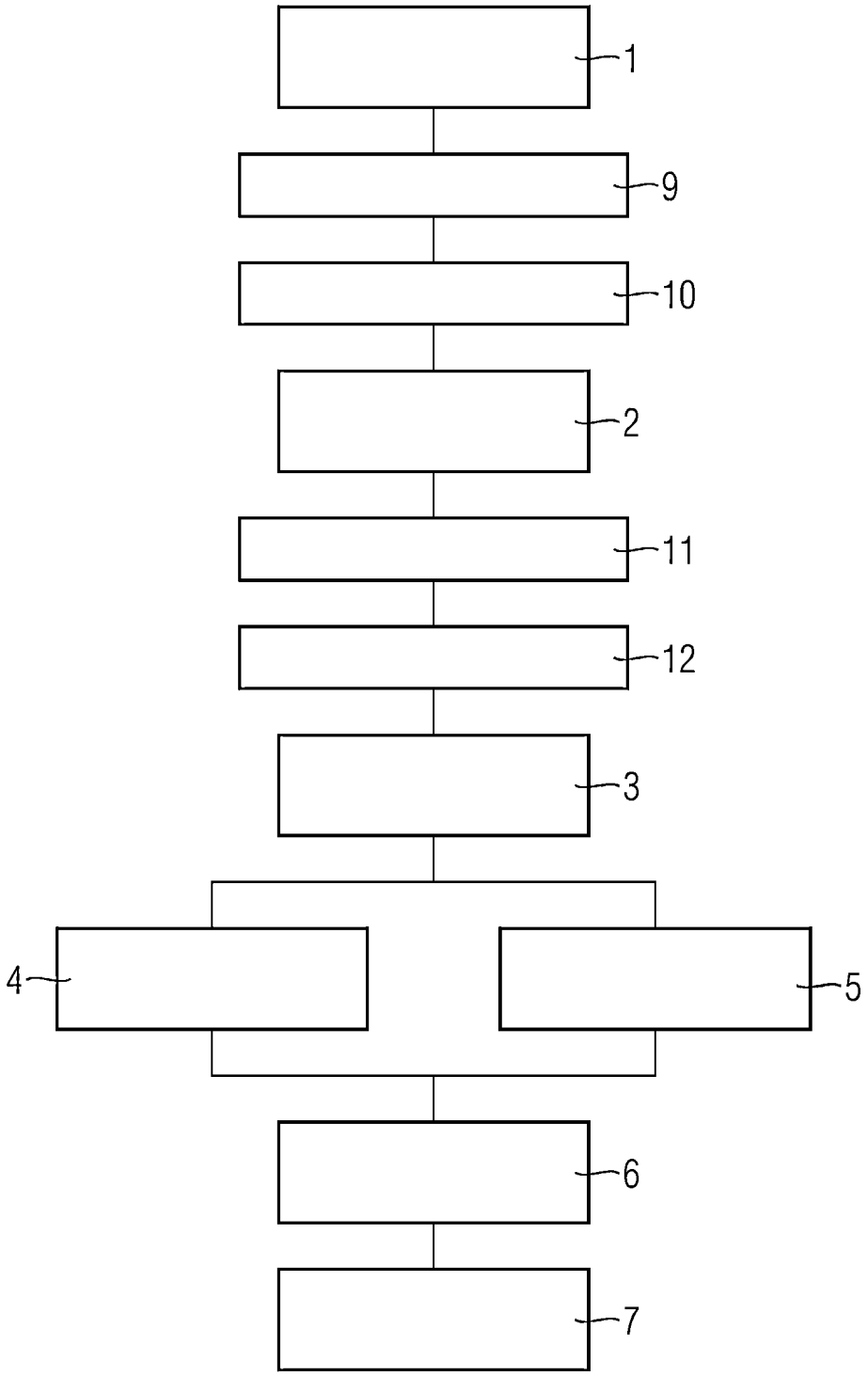
FIG. 3 shows the operation of the method according to FIG. 1 in connection with a change of classification.

FIG. 3 schematically shows the operation of the method according to FIG. 1 in connection with a classification proposal. As indicated in FIG. 1, the sequence of steps in the form of rectangles indicates a possible chronological order. Other orders are also possible while maintaining the causal interconnections.

In the exemplary embodiment shown here, after the audio signal 8 is provided, a first value of an audio feature is generated from the audio signal 8 in step 9 at a first time point. As before, it is also possible to take a multiplicity of values of different audio features into consideration instead of a single value here. On the basis of this first value of the audio feature, a classification is selected in step 10. This selection takes place in accordance with a generally known method for the classification of audio signals.

Both of the above described steps 9 and 10 are repeated in the subsequent steps 11 and 12. This means that a second value of the audio feature is generated in step 11 at a second time point, said value being the basis of a further classification selection. The now adapted classification may differ from the previously selected classification. In such a case, the chosen classification at the second time point corresponds to the proposal for a change of classification. This proposal is not initially performed, however.

In the step 2 in the interval between the first time point and the second time point, the temporal sequence of the values of the audio feature is generated as described above in relation to FIG. 1. As in FIG. 1, this sequence of values is the basis for the method steps 3 to 7. In step 7, the actual performance of the change of classification depends on the comparison of the two difference sums, as described above.

Figure 4:
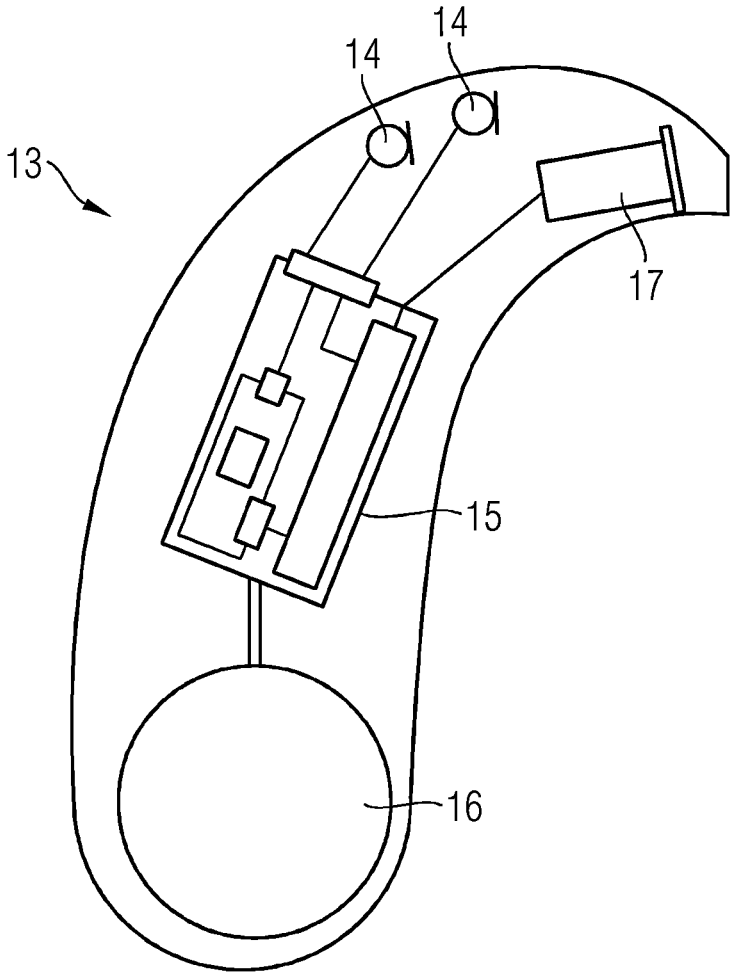
FIG. 4 shows a hearing aid having a signal processor for performing the method according to FIG. 3.

FIG. 4 shows a hearing aid 13 comprising two microphones 14, an arrangement 15 of electronic components for signal processing, a battery 16 and an earphone 17 for sound generation. The microphones 14 provide an audio signal 8. Directivity can be achieved by the two microphones 14 by means of selective signal processing. The audio signal 8 is carried to the arrangement 15 via electric leads. The arrangement 15 is supplied with an electric current by the battery 16. After signal processing of the audio signals 8, the processed audio signal is forwarded to the earphone 17 for output.

Figure 5:
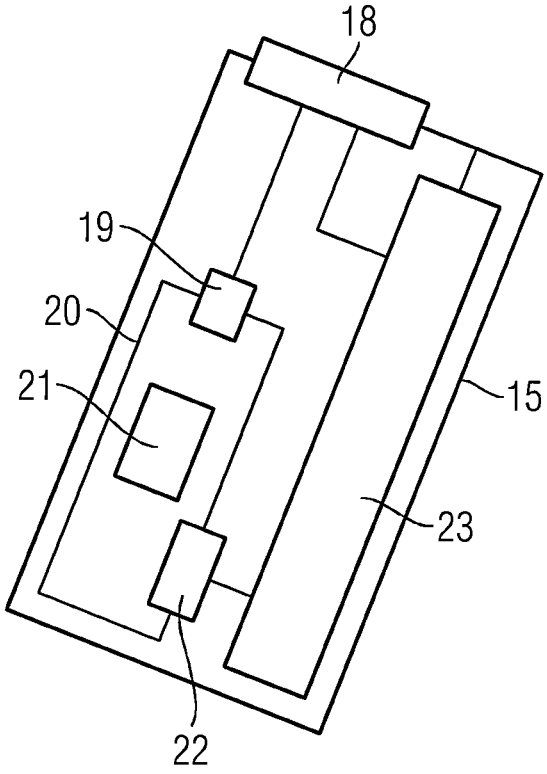
FIG. 5 shows a magnified view of the signal processor from the hearing aid according to FIG. 4.

FIG. 5 shows a magnified view of the arrangement 13 of electronic components for signal processing as per FIG. 4.

The audio signal 8 from the microphones 14 arrives via an electric contact 18 at an input interface 19 of a signal processor 20. A classification unit 21 in the signal processor 20 performs the method for classification of the audio signal 8 as described with reference to FIG. 3. The result of the classification is passed on via a classification output 22 and an audio processor 23.

The audio processor 23 also receives the audio signal 8 directly from the microphones 14 via the contact 18. On the basis of the selected classification in each case, the audio processor 23 processes the audio signal 8 by applying a processing program which corresponds to the classification and is adapted to the respective hearing situation. The processed audio signal is forwarded to the earphone 17 of the hearing aid 13 by the audio processor 23. An optional amplifier for the processed audio signal, which may be connected in series, is not illustrated in the drawing for the sake of simplicity.

In conclusion, the underlying concept of at least one embodiment of the invention is summarized here again: the invention relates to the adaptation of the classification of an audio signal as a function of a comparison between two difference sums of audio features over time periods of different length. Thus, an adequately exact yet quickly reacting adaptation of the classification in changing hearing situations is ensured. The method according to the invention is advantageously used in a hearing aid. The audio signal is processed in different ways on the basis of the classification.

Although the invention has been illustrated and described in detail with reference to the preferred exemplary embodiment, it is not limited by the examples disclosed herein and other variants can be derived therefrom by a person skilled in the art without thereby departing from the scope of the invention.

The invention claimed is:

1. A method for adapting a classification of an audio signal, which comprises the steps of:
- providing the audio signal;
- generating a temporal sequence of values of an audio feature of the audio signal;
- forming a temporal sequence of differences of consecutive values;
- summing the temporal sequence of differences to give a first sum over a first time period;
- summing the temporal sequence of differences to give a second sum over a second time period, being longer than the first time period;
- comparing the first sum with the second sum; and
- performing a change of the classification of the audio signal in dependence on the comparing step.

2. The method according to claim 1, which further comprises selecting the audio feature from the group consisting of a mean value of the audio signal and a variance of a level of the audio signal.

3. The method according to claim 1, which further comprises performing the comparing step by means of a quotient from the first sum and the second sum.

4. The method according to claim 1, which further comprises:
- generating a temporal sequence of values of various types of audio features; and
- forming a difference from individual differences of the consecutive values of audio features of a same type.

5. The method according to claim 4, which further comprises weighting the individual differences according to a type of a respective audio feature when forming the difference.

6. The method according to claim 4, which further comprises combining values of the various types of audio features into a feature vector and the difference is obtained in a form of a distance between consecutive feature vectors.

7. The method according to claim 1, which further comprises performing the change of the classification in dependence on a currently selected classification.

8. The method according to claim 1, which further comprises setting the first time period to have a duration of 2 to 5 seconds and the second time period to have a duration of 10 to 20 seconds.

9. A method for classifying an audio signal, which comprises the steps of:
- providing the audio signal;
- generating a first value for an audio feature from the audio signal at a first time point;
- selecting a classification of the audio signal in dependence on the first value of the audio feature;
- generating a second value for the audio feature from the audio signal at a second time point;
- preparing a change of the classification by selecting a proposal for an adapted classification in dependence on the second value of the audio feature;
- generating a temporal sequence of values of the audio feature of the audio signal in an interval between the first time point and the second time point;
- forming a temporal sequence of differences of consecutive values;
- summing the temporal sequence of differences of consecutive values to give a first sum over a first time period;
- summing the temporal sequence of differences of consecutive values to give a second sum over a second time period, the second time period being longer than the first time period;
- comparing the first sum with the second sum; and
- performing a change of the classification according to a proposal for an adapted classification in dependence on a comparison.

10. The method according to claim 9, which further comprises performing the change of the classification in dependence on the proposal for the adapted classification.

11. A signal processor for classifying an audio signal, the signal processor comprising:
- an input interface for receiving the audio signal;
- a classification unit programmed to perform the steps of:
  - provide the audio signal;
  - generate a first value for an audio feature from the audio signal at a first time point;
  - select a classification of the audio signal in dependence on the first value of the audio feature;
  - generate a second value for the audio feature from the audio signal at a second time point;
  - prepare a change of the classification by selecting a proposal for an adapted classification in dependence on the second value of the audio feature;
  - generate a temporal sequence of values of the audio feature of the audio signal in an interval between the first time point and the second time point;
  - form a temporal sequence of differences of consecutive values;
  - sum the temporal sequence of differences of consecutive values to give a first sum over a first time period;
  - sum the temporal sequence of differences of consecutive values to give a second sum over a second time period, the second time period being longer than the first time period;
  - compare the first sum with the second sum;
  - perform a change of the classification according to the proposal for the adapted classification in dependence on a comparison; and
- a classification output for outputting the classification.

12. A hearing aid, comprising:
- a microphone for providing an audio signal;

a signal processor for classifying the audio signal, said signal processor containing:

an input interface for receiving the audio signal;

a classification unit programmed to perform the steps of:

provide the audio signal;

generate a first value for an audio feature from the audio signal at a first time point;

select a classification of the audio signal in dependence on the first value of the audio feature;

generate a second value for the audio feature from the audio signal at a second time point;

prepare a change of the classification by selecting a proposal for an adapted classification in dependence on the second value of the audio feature;

generate a temporal sequence of values of the audio feature of the audio signal in an interval between the first time point and the second time point;

form a temporal sequence of differences of consecutive values;

sum the temporal sequence of differences of consecutive values to give a first sum over a first time period;

sum the temporal sequence of differences of consecutive values to give a second sum over a second time period, the second time period being longer than the first time period;

compare the first sum with the second sum;

perform a change of the classification according to the proposal for the adapted classification in dependence on a comparison; and a classification output for outputting the classification;

an audio processor for processing the audio signal in accordance with a processing program in dependence on the classification of the audio signal; and an earphone for outputting a processed audio signal.

* * * * *